United States Patent [19]

Martin

[11] 4,445,292

[45] May 1, 1984

[54] BOLT LATCH FOR BOLT-ACTION FIREARM

[75] Inventor: Fred E. Martin, Frankfort, N.Y.

[73] Assignee: Remington Arms Company, Inc., Bridgeport, Conn.

[21] Appl. No.: 511,449

[22] Filed: Jul. 7, 1983

Related U.S. Application Data

[63] Continuation of Ser. No. 290,693, Aug. 6, 1981.

[51] Int. Cl.[3] ..... F41C 11/06

[52] U.S. Cl. ..... 42/16; 42/69 A; 42/70 R

[58] Field of Search ..... 42/16, 69 A, 70 R, 70 F

[56] References Cited

U.S. PATENT DOCUMENTS 1,318,423 10/1919 Williams ..... 42/16
1,322,514 11/1919 Bader ..... 42/16
3,138,888 6/1964 Brewer ..... 42/70 E
4,305,218 12/1981 Godsey ..... 42/70 R X

*Primary Examiner*—Charles T. Jordan
*Assistant Examiner*—Ted L. Parr
*Attorney, Agent, or Firm*—Nicholas Skovran; William L. Ericson; Barry Estrin

[57] ABSTRACT

A bolt-action firearm, of the type having a bolt rotatably movable between closed and open positions, has an improved bolt latch mechanism which is operable independently of a safety mechanism. The latch locks the bolt in closed position automatically when the firing pin is cocked, and releases the bolt upon firing. The latch mechanism is recessed in the bolt plug in such fashion that it is readily visible and accessible, yet does not interfere with normal manual operation of the firearm, and does not protrude so that it might readily be displaced accidentally. In one embodiment, the latch may be manually displaced to or from a disabled position, in which it is releasably detented.

7 Claims, 6 Drawing Figures

BOLT LATCH FOR BOLT-ACTION FIREARM

This application is a continuation of application Ser. No. 290,693 filed Aug. 6, 1981.

This invention relates to firearms of the bolt-action type, which have a bolt reciprocable in a receiver between open and closed portions, and rotatable by means of a handle between locked and unlocked relationship to the firearm barrel. The invention is particularly concerned with an improved bolt latch mechanism which is normally operated automatically by the firing and re-cocking of the firearm, but which may be selectively disabled, according to the user's wishes.

In a bolt-action firearm intended for hunting use, it is desirable to provide both a safety, and a bolt latch for securing the bolt locked in a closed position. These two features allow the firearm to be carried in the field loaded and cocked, without risk either of accidental firing, or of the bolt being unlocked by some accidental jar or collision. At the same time, the user should be enabled to open the bolt readily and safely for unloading. Controls for the safety and bolt latch should be simple enough to avoid confusion in poor lighting conditions; should be readily manipulable even by a hunter wearing gloves; and yet should not protrude in a manner either to interfere with manual operation of the firearm, or to be susceptible to inadvertent displacement.

One approach to this question is shown in U.S. Pat. No. 2,514,981 to Walker et al, in which a two-position safety lever also serves as a bolt latch. The safety lever has two arms: a safety arm bearing an eccentric which blocks the sear of the trigger mechanism in a "safe" position of the lever; and another latch arm which engages a notch in the bolt to latch it against rotation. Movement of the safety lever to the "fire" position releases the sear, and also removes the latch arm from engagement with the bolt. This is a satisfactory system; but it does require the safety to be released when the bolt is opened, and therefore calls for proper caution to be exercised when the user wishes to unload the firearm.

Another prior art solution involves a safety lever movable to three positions: one in which the safety and the bolt latch are both engaged; a second, intermediate position which either disengages the bolt latch, or enables it to be manually disengaged, but leaves the safety on; and a third, firing position in which both the safety and the bolt latch are inoperative. Examples of this approach appear in U.S. Pat. Nos. 2,824,402 to Fischer; 1,318,423 to Williams; 2,869,269 to Couture; and 3,138,888 to Brewer. If a hunter is working in good lighting conditions, without gloves, and with leisure to see that the safety is correctly positioned, these systems are satisfactory. But in the press of urgency and excitement that often arises in the field, and under adverse conditions, error in selecting among three safety positions is not unlikely to occur.

Another solution that has been suggested is to provide a bolt latch that is completely divorced from the safety mechanism. This enables the hunter to unload without concern about changing the condition of a safety he has previously activated. Two examples of such a bolt latch are found in U.S. Pat. Nos. 1,322,514 to Bader, and 1,669,496 to Stahl. In Bader, a sliding latch, mounted on the side of the bolt plug just behind the bolt handle, is movable to or from latching engagement with the bolt handle by means of a pivoted lever, which is spring-biased toward the latch-engaging position. The latch may be withdrawn either by lever engagement with a shoulder on the firing pin when the rifle is fired, or by manual rotation of the pivoted lever. After manual opening with the rifle cocked, the pivoted lever must be held manually retracted in order to re-close the bolt.

In the Stahl Patent, a rotatable shaft, formed with a flat and carrying a spring-biased latch plunger, extends tranversely across a mating flat in the firing pin. The cocking of the firing pin mates the two flats so as to turn the shaft and latch plunger into locking engagement with the bolt handle. Upon firing, the flats disengage so that the bolt handle may be raised, with the shaft and latch plunger now being free of the firing pin and able to rotate to permit this opening movement. If it is desired to unload the rifle with the firing pin cocked, the latch plunger may be retracted manually to permit the bolt to be opened. The latch plunger must once again be held retracted to permit the bolt to be re-closed; this disadvantage is shared by Bader and Stahl.

The present invention has as its general object the improvement of bolt latch mechanisms for bolt-action rifles which have independently-operable safety devices. The improved mechanism features a simplified construction, involving a single pivoted, spring-loaded latch lever, which is automatically operated by the displacements of a firing pin during cocking and firing. In one embodiment, a detent is provided so that the latch is selectively operable manually to releasably secure it in a disabled position. The latch may readily be disabled or reactivated by the press of even a gloved finger, after which the hands are free to carry out loading, cocking, firing, or unloading operations without further attention to the latch.

According to the invention, the bolt plug of a bolt-action firearm is recessed to receive a latch lever, which is pivotally mounted in the recess for rocking motion to either of two positions: latched by cocking the weapon and closing the bolt handle; or unlatched by firing the weapon. A spring and plunger bias the lever toward the latched position, in which a tooth formed at one end of the lever engages in a mating notch in the closed bolt handle. The latch lever has a cam surface so arranged, in the latched position, as to project into the path of motion of the head of the firing pin, which therefore pivots the lever to the unlatched position when the weapon is fired. Subsequent re-cocking and withdrawal of the firing pin head enables the spring-loaded plunger to return the lever automatically to the latched position.

In one embodiment, the latch lever may be manually rocked beyond the latched position to a disabled position, in which a detent notch formed in the lever engages and interferes with movement of the spring-loaded plunger. The plunger cannot then move the lever toward the latched position until the lever is manually pressed in a direction to release the detent and thus restore automatic operation.

Figure 1:
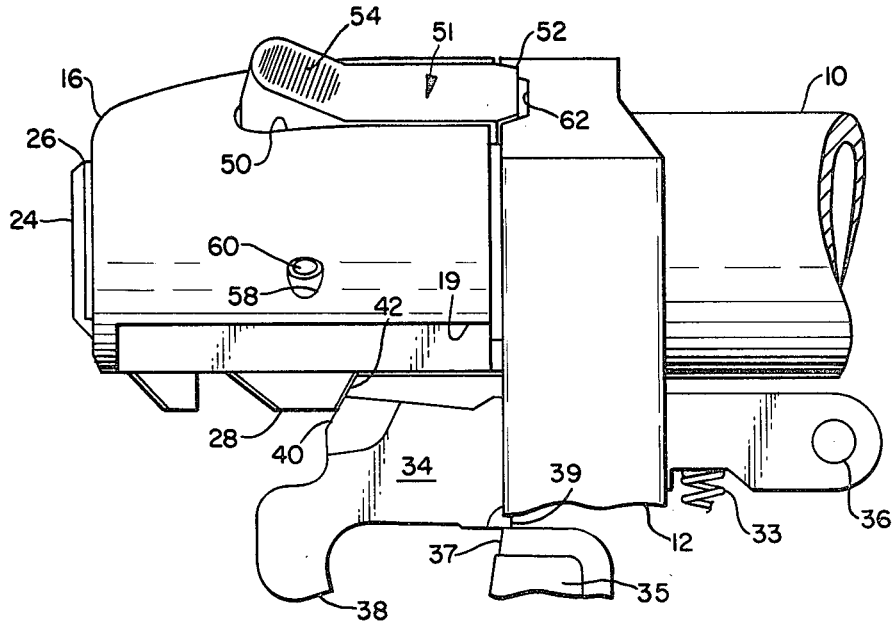
FIG. 1 is a fragmentary view in side elevation of one embodiment of the improved bolt latch mechanism, shown in latched relation to the bolt assembly of an illustrative bolt-action firearm, which is shown cocked and ready to fire.

The improved bolt latch mechanism is broadly applicable to bolt-action firearms of various designs, but is shown for purposes of illustration in a bolt-action rifle of substantially the same type as is shown in more detail in U.S. Pat. Nos. 2,585,195 to Walker and 2,514,981 to Walker et al, which were assigned to the owner of the present application. The rifle includes a hollow cylindrical bolt 10 which is mounted for rotation and longitudinal reciprocation in a receiver (not shown), by means of a handle 12 brazed or otherwise secured to the bolt. The bolt, when closed against the breech of the rifle barrel, may be locked by means of conventional lugs formed on its forward end (not shown), which are engaged by rotating the handle down into the position shown in FIGS. 1 and 2, or unlocked by raising the handle to the position of FIG. 3. The bolt is shown in its closed longitudinal position wih respect to elements of a fire control mechanism which includes a sear 34 and a trigger 35. With the bolt turned to its unlocked position of FIG. 3, it may be pulled longitudinally to the left to open the action for loading and unloading cartridges, and for cocking a firing pin 24.

A bolt plug 16 has a threaded extension 18 which extends forwardly into threaded engagement with internal threads 14 formed in the bolt, thus drivingly connecting the bolt and bolt plug for joint longitudinal reciprocation, but permitting the bolt to rotate independently. The bolt plug is formed with recessed flats 19 for sliding engagement with mating surfaces formed on the receiver (not shown), to restrain the bolt plug from rotating with the bolt. The bolt plug also has a cylindrical recess 20 slidably receiving an enlarged head 26 of the firing pin 24, and a slot 22 through which a sear-engaging lug 28 and a cocking arm 30 of the firing pin extend in freely-slidable but non-rotatable relation.

Figure 2:
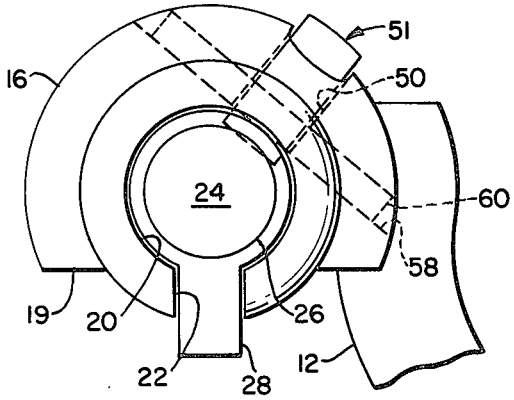
FIG. 2 is a fragmentary view in rear elevation of the assembly of FIG. 1.
Figure 3:
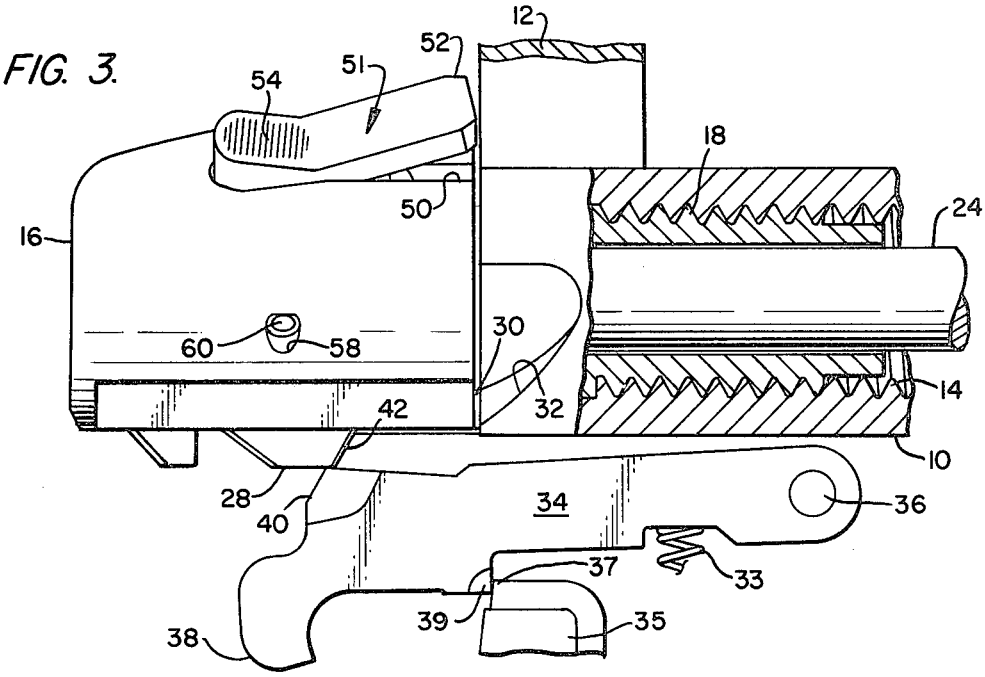
FIG. 3 is a fragmentary view showing the latch in unlatched position, with the bolt handle raised to unlock the bolt, and the parts of the firearm in fired and uncocked condition.
Figure 4:
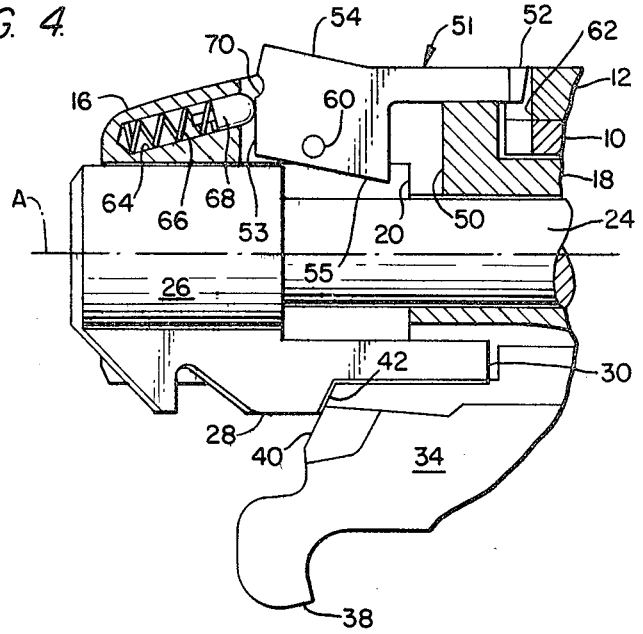
FIG. 4 is a fragmentary cross-sectional view in side elevation, with the parts in the same latched and cocked condition as in FIG. 1.

In the relative positions of these elements shown in FIGS. 1 and 4, the firing pin 24 is cocked, with an oblique face 42 of the lug 28 bearing against a mating face 40 of the sear 34. The firing pin is continuously urged toward a firing position, that is, toward the right in the drawings, by a conventional firing pin spring contained within the bolt. The sear, pivoted on a pin 36, is held in its illustrated angular position by the engagement between a step 39 in the sear and a connector 37 attached to the trigger 35, thereby restraining the firing pin in its cocked position. To fire the weapon, the trigger is pulled to move the connector 37 to the position shown in FIG. 3. The angle of the faces 40 and 42 with respect to the longitudinal axis of the bolt and firing pin is such that the firing pin spring exerts a downward component of force on the sear that overcomes the upward force exerted by a sear spring 33, and pivots the sear counterclockwise to the position shown in FIG. 3, permitting the firing pin to be driven forwardly to its fired position shown in FIG. 5.

In the fired condition, the cocking arm 30 of the firing pin extends forwardly into the deepest part of a cocking cam 32 cut into the bolt 10, which is circumferentially aligned with the cocking arm when the bolt is closed (compare FIGS. 1 and 3). After firing, raising the bolt handle to the position of FIG. 3 causes the cocking arm to ride along the curved surface of the cam 32, and retracts the firing pin back toward the cocked position. Then as the bolt is opened and re-closed by a reciprocating movement along its major axis, the lug face 42 engages against the re-elevated sear face 40 and retains the firing pin in the cocked condition of FIGS. 1 and 4 once more.

The firearm action thus far described is conventional in design, and is further illustrated and described in the aforementioned U.S. Pat. Nos. 2,585,195 and 2,514,981. Therefore, no further detailed description of its operation and design is believed necessary. A safety mechanism of any type suitable to such an action may be utilized as desired, and the bolt latch of the present invention is intended to operate entirely independently of the safety mechanism. As illustrated, the sear 34 is provided with a cam lobe 38 for cooperation with a safety lever having an eccentric, of the kind disclosed in U.S. Pat. No. 2,514,981, which is selectively operable to block the sear against movement from the cocked position of FIG. 1. This is intended merely as an illustrative example of various safety mechanisms that might by used in conjunction with the improved bolt latch, which will now be described.

The bolt plug 16 is formed with a radially-extending recess 50, in which a latch lever 51 is pivotally supported on a pin 60 received in a tranverse hole 58. The lever 51 has a tooth 52 at its forward end, which, in a latched position of FIGS. 1 and 4, engages in a locking notch 62 at the rear of the bolt 10 and handle 12 to prevent the bolt from being moved from its closed and locked position. A plunger 68 is slidably received in a blind hole 64 in the bolt plug, and is urged against a rear face 53 of the lever 51 by a spring 66 to bias the lever in a clockwise direction toward the latched position.

Figure 5:
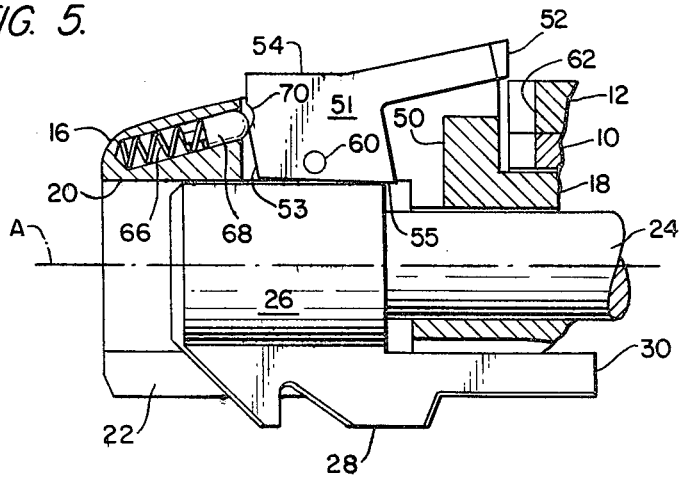
FIG. 5 is a view similar to FIG. 4, but showing the firing pin in a fired position, and the latch mechanism is an unlatched position.

The latch lever 51 is formed with a planar cam surface 55 which projects into the recess 20 in the latched position of FIG. 4, into the path of movement of the outer cylindrical surface of the firing pin head 26 from its cocked position of FIG. 4 to its fired position of FIG. 5. In the latched position, the cam surface 55 extends in a direction inclined downwardly in a forward direction with respect to the longitudinal axis A of the firing pin motion. When the trigger 35 is pulled to release the firing pin, the forwardly-moving cylindrical head 26 engages the cam surface 55 and pivots the lever 51 to the unlatched position shown in FIG. 5, against the bias of the spring-loaded plunger 68. The bolt 10 is now free to turn, and may be unlocked and opened. The surface 55 continues to be inclined downwardly in a forward direction, for a reason which will appear, but at a greatly reduced angle to the bolt axis A.

Re-cocking of the firing pin 24 frees the cam surface 55 from the head 26. This allows the plunger 68 to automatically re-latch the lever 51 in the position of FIG. 4, as the bolt handle is closed and the locking notch 62 becomes aligned with the tooth 52.

In the illustrated embodiment, the rear face 53 of the latch lever is formed with a detent notch 70, which is not reached by the plunger 68 sliding along the face 53 during the pivotal movements of the lever between the latched position of FIG. 4 and the unlatched position of FIG. 5. However, the lever may be rocked, by applying finger pressure to a projecting V-shaped upper surface 54, counterclockwise into a further disabled position shown in FIG. 6, in which the plunger 68 seats in the notch 70. The engagement between the plunger and the notch restrains the lever against being rotated by the bias of the spring 66, and thus detents the lever in this disabled position.

To provide for an ample arcuate displacement between the unlatched and disabled positions of the lever 51, the surface 55 must have some clearance from the head 26. Thus this surface is inclined downwardly at a small angle to the axis A in both the unlatched and the disabled positions, but in opposite axial directions.

Figure 6:
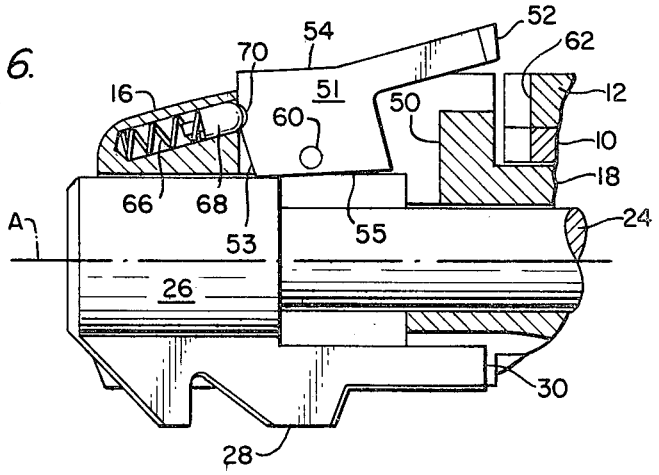
FIG. 6 is a view similar to FIGS. 4 and 5, but showing the firing pin in a cocked position, and the latch mechanism detented in a disabled position.

When placed in the disabled, detented position of FIG. 6, the latch lever 51 will remain inoperative and unaffected by movement of the firing pin, until such time as finger pressure is applied to it in a clockwise direction to release the plunger 68 from the notch 70, and thus restore the parts to the normal automatically-operating positions of FIGS. 4 and 5.

In a hunting situation in the field, where a series of shots may be fired, the bolt is cyclically opened to reload the rifle, and reclosed to cock the firing pin for the next shot; and the latch lever automatically cycles between the latched and unlatched positions of FIGS. 4 and 5. Assuming, however, that the hunter wishes to unload the cocked and latched rifle without firing previously-loaded live rounds, he need not release the safety to do so. He merely presses the latch lever 51 into the disabled position of FIG. 6, and opens the bolt with the safety engaged. When he next wishes to reload the rifle, the latch lever should be pressed to release it from the detented disabled condition, so that its normal automatic operation is restored.

The latch lever 51 is preferably positioned near the top of the bolt plug as shown, so that it is readily visible and easily pressed even with a gloved hand, but does not protrude in such a location as to be readily subject to accidental operation by the user's hand carrying the rifle, or by jarring against other objects.

I claim:

1. In a bolt-action firearm of the type having a substantially cylindrical bolt rotatably mounted for movement between open and closed positions; a bolt plug non-rotatably mounted and having threaded connection with said bolt; a firing pin mounted reciprocably in said bolt plug for movement between fired and cocked positions with respect to said bolt; the improved bolt latch mechanism which comprises;

a latch lever having a tooth; said bolt plug being formed with a recess receiving said latch lever; said bolt being formed with a locking notch opening onto an outer peripheral surface thereof at a location radially aligned with said tooth upon rotation of said bolt to said closed position; means mounting said latch lever in said recess for pivotal movement about an axis substantially perpendicular to the longitudinal axis of said cylindrical bolt between a first, latched position in which said tooth is engaged in said locking notch to latch said bolt against rotation with respect to said bolt plug, and a second, unlatched position in which said tooth is disengaged from said locking notch to release said bolt for rotation; spring-biased plunger means mounted in said bolt plug for biasing said latch lever toward said first position;

said latch lever having cam means arranged to project, upon pivotal movement of said latch lever into said first position, into the path of reciprocation of said firing pin, whereby movement of said firing pin to said fired position normally pivots said latch lever from said first to said second position to unlatch said bolt, and movement of said firing pin to said cocked position normally permits said spring-biased plunger means to pivot said latch lever from said second to said first position to latch said bolt;

said latch lever having a detent notch, and being manually pivotable in said recess to a third, disabled position in which said cam means is withdrawn from the path of reciprocation of said firing pin, said tooth is released from said locking notch and said detent notch engages said plunger means to interfere with rotation of said latch lever from said third position, and thereby render said plunger means inoperative to pivot said latch lever toward said first position thereof.

2. A bolt latch mechanism as recited in claim 1, said latch lever being manually pivotable from said disabled position toward said latched and unlatched positions thereof, by applying pressure sufficient to displace said plunger means from said detent notch.

3. A bolt latch mechanism as recited in claim 1, said latch lever having a face area normally bearing against said plunger means for relative sliding movement as said latch lever is pivoted between said latched and unlatched positions, said detent notch being formed in said face in a location spaced from said bearing area to engage said plunger means in said disabled position of said latch lever.

4. A bolt latch mechanism as recited in claim 1, said latch lever being pivotable: in a first angular direction into said unlatched position; in an opposite angular direction into said latched position; and beyond said unlatched position in said first angular direction into said disabled position.

5. A bolt latch mechanism as recited in claim 4, said firing pin being formed with a head having a peripheral surface cylindrical about the axis of movement of said firing pin; said cam means comprising a cam surface formed on said latch lever; said latch lever being constructed and pivotally mounted so that in said latched position thereof, said cam surface is inclined toward the axis of reciprocation of said firing pin in the direction of movement of said head from said cocked to said fired positions thereof, for sliding engagement by said head surface.

6. A bolt latch mechanism as recited in claim 5, said latch lever being constructed and pivotally mounted so that in said unlatched position thereof, said cam surface slidably engages said head surface and remains inclined to the axis of reciprocation of said firing pin in the direction of movement of said head from said cocked to said fired positions thereof, but at a smaller angle than in said latched position of said latch lever, thereby permitting further pivotal movement of said latch lever in said first angular direction into said disabled position without producing binding interference between said cam surface and said head surface.

7. A bolt latch mechanism as recited in claim 1, said latch lever projecting from said bolt plug recess outwardly of said bolt plug, and having a V-shaped upper surface for manual rocking between said disabled position and said latched and unlatched positions.

* * * * *